US005080245A

United States Patent [19]

Conard

[11] Patent Number: 5,080,245

[45] Date of Patent: Jan. 14, 1992

[54] BIDIRECTIONAL SCORING

[75] Inventor: William A. Conard, Harleysville, Pa.

[73] Assignee: The West Company Incorporated, Phoenixville, Pa.

[21] Appl. No.: 497,550

[22] Filed: Mar. 22, 1990

[51] Int. Cl.[5] ..... B65D 51/18

[52] U.S. Cl. ..... 215/249; 215/251; 215/254

[58] Field of Search ..... 215/249, 251, 254, 274, 215/258; 220/257, 270

[56] References Cited

U.S. PATENT DOCUMENTS

| | | | |
|---|---|---|---|
| 1,994,257 | 3/1935 | Sorgan | 220/257 |
| 2,108,583 | 2/1938 | Falk | 215/274 |
| 2,236,491 | 3/1941 | Campbell | 215/249 |
| 3,071,274 | 1/1963 | Raun | 215/249 |
| 3,358,865 | 12/1967 | Andersen | 215/249 |
| 3,480,171 | 11/1969 | Rohde | 215/251 |
| 3,547,297 | 12/1970 | Herbert | 215/249 |
| 3,587,897 | 6/1971 | Rohde | 215/249 |
| 3,596,790 | 8/1971 | Leftault | 215/274 X |
| 4,471,879 | 9/1984 | Conner et al. | 215/249 |
| 4,784,279 | 11/1988 | Osting et al. | 215/251 |

FOREIGN PATENT DOCUMENTS

| | | | |
|---|---|---|---|
| 2395911 | 3/1979 | France | 215/249 |

*Primary Examiner*—Stephen Marcus
*Assistant Examiner*—Stephen Cronin
*Attorney, Agent, or Firm*—Eugene E. Renz, Jr.

[57] ABSTRACT

A closure device for use with a container, comprising cap means with a pull tab and scoring to remove the cap, the scoring including stepped scoring on both sides of the cap with each scoring having a frangible interruption proximate the top radial edge of the cap.

9 Claims, 2 Drawing Sheets

BIDIRECTIONAL SCORING

FIELD OF THE INVENTION

The present invention relates to an improved closure device for use with containers, particularly those having rubber stoppers, such as those containers used in the pharmaceutical industry. More particularly, the invention relates to a cap means with a pull tab and scoring which permits bidirectional removal of the cap by pulling on the tab.

BACKGROUND OF THE INVENTION

Closure assemblies employing a tear off band with a pull tab have been provided for use with containers generally. These devices have found particular use in the pharmaceutical industry.

Pharmaceutical containers for liquids or for solids which are reconstituted by the addition of liquids have a pierceable closure member such as a disc or stopper formed of rubber or other elastomers. They are also provided with a metallic cap, preferably aluminum, to hold the stopper in place.

In some designs, an inner central removable disc is detachably secured to the outer annular top portion of a cap through the use of fracturable bridges. Thus, by lifting off this center disc portion, the stopper area is exposed and access to the contents is provided.

Among these designs are those shown in U.S. Pat. No. 4,071,274, in which the cover is removed by pushing with the thumb. U.S. Pat. No. 3,547,297 discloses a cap with a lift off top and U.S. Pat. No. 3,587,897 discloses a similar cap, including a depending skirt which is adapted to be crimped inwardly at its lower edge around or over the outer bead finish on the container to further secure the stopper or disc in place.

Still another alternative technique is the use of a tear off cap which provides a hinged central portion at the top of the cap to provide a grip for tearing off the cover over the stopper and around the top of the container. These systems include a cap portion and a pull tab section with lines or scores for guiding the direction or the tear. These tear off closure designs have not been found to be universally acceptable, particularly in high speed assembly systems because of possible breakage during manufacture. The junction between the pull tab and the cap is often destroyed or damaged during high speed assembly. The disc or pull tab also has a tendency to become damaged when the stopper itself is inserted into the closure. In addition, pull tabs and discs fall out and lines or scores open or bend during hoppering and sealing procedures.

U.S. Pat. No. 4,471,879 describes a combination of the over cap which can be removed by the thumb and includes a conventional tear off cover having a hinged central portion and a pull tab for removing the cover. That patent provides an additional advantage of color coding various portions of the apparatus to convey information to the pharmacist or other hospital personnel using the container.

It has become clear that the assembly of pharmaceutical products in containers as described above in the most economical manner possible allows the supplier to pass on economies and efficiencies to the ultimate user of the product. More importantly, when a design is provided which is free from problems during hoppering, sealing, and other assembly steps, manufacturing efficiencies allow the manufacturer to be much more competitive and supplying what is now becoming a major article of commerce.

Even though the pharmaceutical industry in intensely concerned about the integrity of the product produced, including the closure components, it is also driven by the need for greater efficiency and speed. For example, if a process which is otherwise quite reliable can be operated at a significantly faster average operating speed, the unit cost is reduced without any adverse effect on product quality and integrity.

Accordingly, there appear to be two conflicting goals in efforts made to improve the application of closures to containers, particularly those for high speed assembly in the pharmaceutical industry. On the one hand, it is desirable to increase the strength and durability of the closures prior to assembly, to avoid downtime and a significant quantity of rejected products. On the other hand, the need for easy, quick and convenient opening of the container requires easily broken scoring. This is particularly true because the user of the product has become dependant upon a certain degree of ease, convenience and efficiency in opening containers.

One problem with some prior art closures is that scoring is provided which requires that the ring be turned in a specified direction, such as, for example, to the right. If the ring is pulled to the left, the ring will come off, leaving the band still attached to the container.

Thus, it would be a great advance in the art if a new and improved design could be provided which would allow for effective and rapid sealing with minimum damage to the closure while at the same time maintain or even improve the ease of use of the container by the final user.

These objects will become more apparent upon a reading of the description which follows.

SUMMARY OF THE INVENTION

The invention comprises an improved closure device for use with a container, such as pharmaceutical containers having a thermoplastic elastomer stopper. The closure device comprises a cap means with a top portion and a dependent skirt. The cap is provided with a pull tab and scoring which permits the cap to be quickly and easily removed. The scoring includes stepped scoring on both sides of the cap with a frangible interruption proximate the top radial edge of the cap In a preferred embodiment, the stepped scoring comprises a first scoring line from the pull tab to the top radial edge of the cap and second scoring spaced circumferentially from the first scoring and extending axially down the skirt of the cap from the edge. It is preferred that the stepped scoring on both sides of the pull tab decrease the width of that portion of the cap between the scorings which is located below the top radial edge of the cap.

In another embodiment, it is contemplated that the cap will further include other, radially extending scorings at at least one location on the cap and spaced from the portion of the cap which is attached to the tab and has the stepped scoring.

In one particularly preferred embodiment, the closure device includes an anchoring disc below the cap and has a fracturable bridge means. Also provided is a removable over cap having an annular portion with its lower terminal edge cooperating with the bridge means.

In this manner, removal of the overcap fractures the bridge and exposes the cap means of this invention.

It is preferred that both the anchoring disc and the cap means of this invention are manufactured from aluminum or other similar materials. The overcap is generally preferred to be made from plastic.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 2:
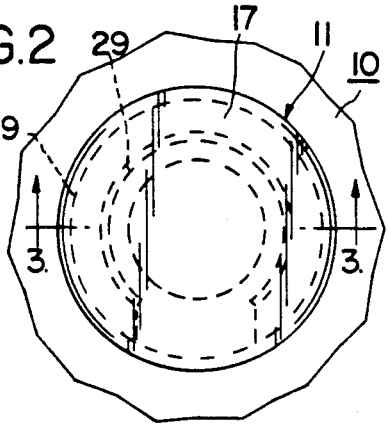
FIG. 2 is a fragmentary plan view of FIG. 1.
Figure 1:
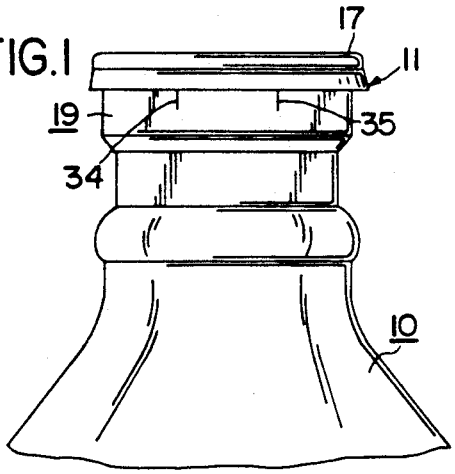
FIG. 1 is a fragmentary side elevational view of a container having the closure of this invention in one preferred embodiment.

As shown in the drawings, bottle 10 includes a closure shown generally by reference numeral 11. The closure includes stopper 13 which fits into neck 15 of bottle 10 in the usual manner.

In the embodiment shown in FIGS. 3 through 6, stopper 13 is provided with removable overcap 17, cap means 19 according to the present invention and anchoring disc 21. These elements are shown assembled in FIG. 3 and prior to assembly in FIG. 4.

Anchoring disc 21 includes bridge ring 23 which is connected to anchoring disc 21 through a plurality of bridges 25. These bridges 25 are fracturable as will be described herein below.

The lower terminal edge 27 of removable overcap 17 is sized to fit axially through pull ring 29 of intermediate cap means 19 and through bridge ring 23 of anchoring disc 21. During assembly, this lower terminal edge 27 is heated or otherwise deformed, so that the terminal edge 27 fits underneath bridge 23, as can best be seen in FIG. 3. One method provides for lower terminal edge 27 to be heated and spun under bridge ring 23 to form the lip of a flange, so that overcap 17 is connected to bridge ring 23.

At the time of use, the application of some pressure on the overcap 17, causes bridges 25 to fracture and overcap 17 will be removed, taking with it bridge ring 23. Once the overcap 17 has been removed, primary cap means 19 is exposed and can be removed when desired. Anchoring disc 21 which remains on stopper 13 can also be discarded when cap means 19 is removed.

Figure 6:
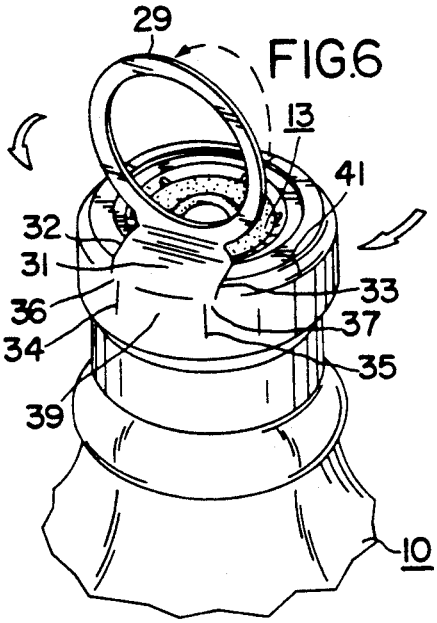
FIG. 6 is a perspective view of the device shown in FIG. 4, after assembly, and in a partially removed condition.
Figure 8:
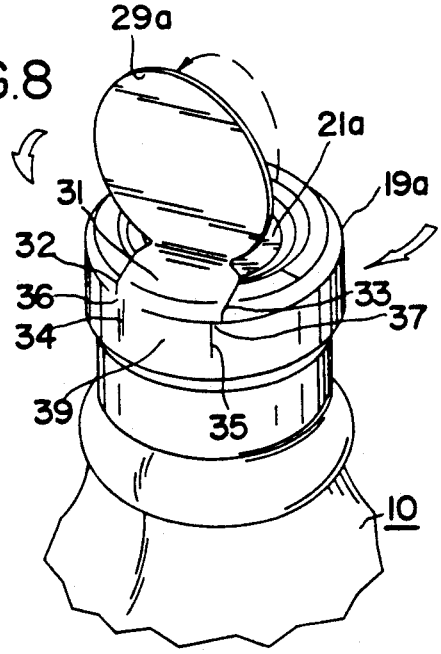
FIG. 8 is perspective view of a modified closure of the preferred embodiment of the present invention.

Cap means 19 of the present invention includes a pull tab 29 which forms the top of the cap 19 and which is shown as a pull ring 29 in FIG. 6 and as a solid pull tab 29A in FIG. 8. Both forms are preferred. The top of the cap 19 terminates in an upper radial edge 30. The skirt portion of the cap 19 descends down from this upper radial edge 30.

Pull tab 29 is attached to cap 19 by cap portion 31 which is adjacent to pull tab 29. This upper cap portion 31 is defined by a pair of score lines 32 and 33 which extend from pull tab 29 to the upper radial edge 30 of cap means 19. Spaced circumferentially from score lines 32 and 33 are another pair of score lines 34 and 35 which extend from upper radial edge 30 down along the skirt of cap means 19. Located between score lines 32 and 34 is a frangible interruption 36. Similarly, frangible interruption 37 is located between score lines 33 and 35. These frangible interruptions 36 and 37 cause the scoring along cap portion 31 connecting tab 29 to cap 19 to take on a "stepped" scoring. The term "stepped" scoring is intended to mean scoring which has a step like break such as frangible interruption 37, so as to cause the score lines 33 and 35, for example, to be parallel but stepped apart from each other as shown.

In the embodiments shown in the drawings, stepped scoring 32-34 and 33-35 causes cap portion 31 adjacent tab 29 to have a greater width than smaller cap portion 39 which begins at the stepped portion of scoring 32-34 and 33-35. When tab 29 is pulled to either side, the stepped scoring which steps in the direction of pull will fracture its frangible interruption and the stepped scoring which steps in the other direction will resist fracture.

It has been found that stepped scoring as shown herein has certain advantages which are not present in prior art designs. Specifically, the dual stepped scoring 32-34 and 33-35, with the stepped scoring causing a decreased width portion 39 below the radial edge 30 of the cap 19, provides a cap means which can be processed in all presently available cap assembly machines including hoppers and capping machines, without concern for damage to the cap means 19. Rate of production is much improved. The design of the stepped scoring 32-34 and 33-35 allows for greater control of breakage in the manufacturing process, provides better disc retention a the design holds the closure and prevents it from opening up when a disc is inserted into a container. Finally, there is significantly better operation in hoppering and sealing equipment since the disc does not fall out of the tear-off cap and the scores do not open.

Figure 7:
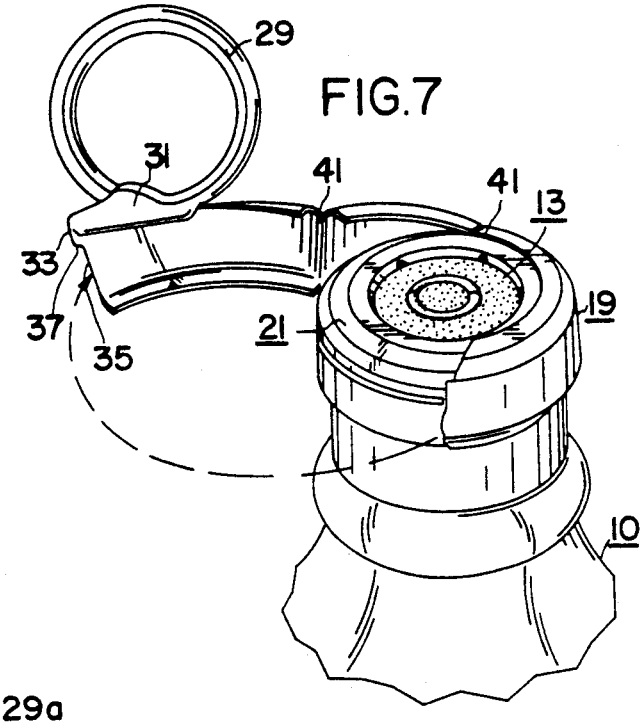
FIG. 7 is an enlarged perspective showing the device of FIG. 6 in further disassembly.

At the time when the device is to be used, tab 29 is lifted, as shown in FIGS. 6 and 7. Stepped scoring 32-34 and 33-35 is bidirectional, in that it permits tab 29 to be twisted in the direction of either arrow shown in FIGS. 5 and 6. Thus, either frangible interruption 36 or frangible interruption 37 will be broken by twisting while pulling the tab 29 upward to separate the upper cap portion 31 from the cap along scoring lines 32 and 33. When frangible interruption 37, for example, is broken by continued pressure and twisting in the direction of the arrow in FIG. 7, for example, it is relatively easy to continue tearing along score line 35. Additional radially extending score lines 41 are provided around the circumference 30 to permit complete removal of cap 19.

Figure 3:
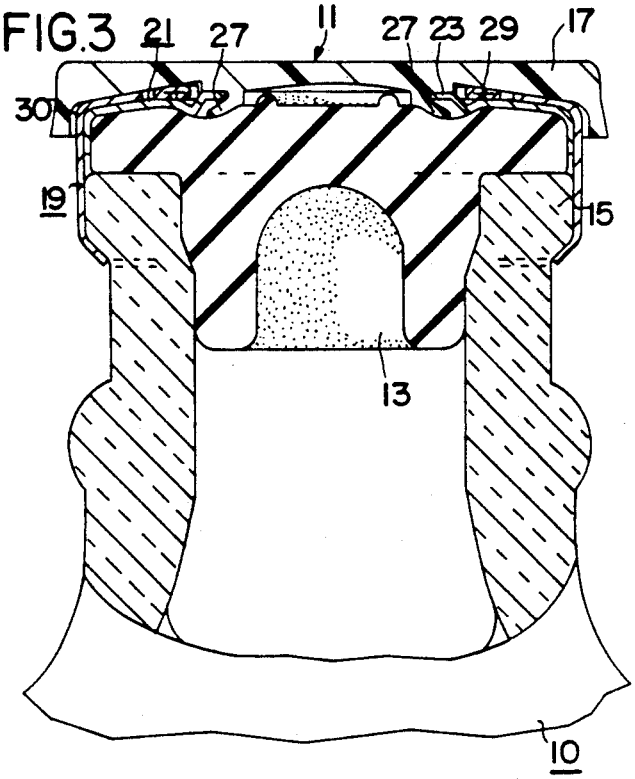
FIG. 3 is a sectional elevational view taken along the line 3—3 of the FIG. 2.
Figure 4:
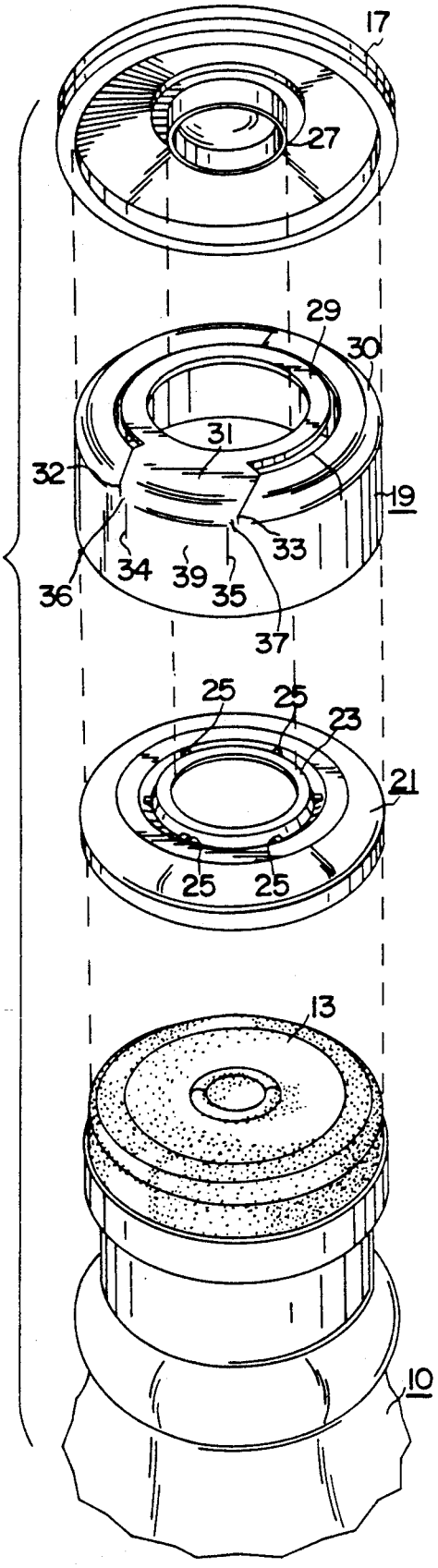
FIG. 4 is an exploded, perspective view showing the elements of a preferred embodiment prior to assembly on a container.
Figure 5:
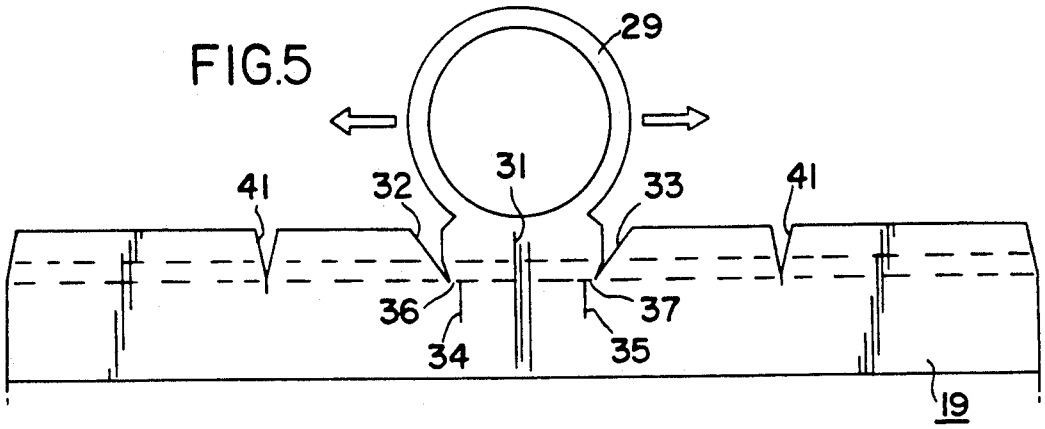
FIG. 5 is a development view showing one element of the preferred embodiment.

In the design shown in FIG. 6, the overcap has been previously removed, leaving an anchoring disc such as disc 21 shown in FIGS. 3 and 4. In FIG. 8, solid tab 29A is lifted, causing the scoring lines 32 and 33 to be broken, the stepped scoring 32-34 or 33-35 can be broken at the radial edge 30 by twisting the tab 29A in the direction shown by either of the solid arrows in FIG. 8. Again, for example, if tab 29A is twisted as shown in FIG. 7, frangible interruption 37 is ruptured and the scoring 35 completes the opening process of cap 19A. In systems which do not employ an overcap, such as shown in FIG. 8, a disc 21A is fitted to protect the elastomeric stopper 13 from contamination prior to use of the container to which it is attached.

From the foregoing, it is clearly apparent that the present invention provides for an improvement in the cap closures for pharmaceutical containers and the like. Significant improvement in assembly speed and reliability has been achieved through several different embodiments, both with and without a removable overcap. Both downtime and rejects have been significantly reduced. At the same time, the cap removal process has been greatly improved since stepped scoring 32–34 and 33–35 provides for bidirectional removal of the cap at the time the device is to be used. Thus, a useful tool in the medical or pharmaceutical industry has been provided and a valuable contribution to the art has been made.

What is claimed is:

1. A closure for use with a container comprising an annular top portion, a skirt depending from the outer periphery of said top portion along a radial edge and an actuatable element connected to the top portion by at least a pair of circumferentially spaced first score lines having terminal ends disposed in said radial edge and second circumferentially spaced score lines having inner terminal ends offset circumferentially relative to the terminal ends of said first score lines and disposed in said radial edge, the terminal ends of said first and second score lines within said radial edge being offset to define a pair of frangible bridges.

2. A closure for use with a container comprising an annular top portion having an outer periphery, a skirt depending from the outer periphery of said top portion along a radial edge, an actuatable element connected to the top portion between at least a pair of circumferentially spaced first score lines having terminal ends disposed in the radial edge and second circumferentially spaced score lines having inner terminal ends offset circumferentially relative to the terminal ends of said first score lines and disposed in the radial edge, said second score lines extending downwardly axially along the skirt so that the opposite ends of said second score lines are located approximately at the midpoint of said skirt whereby said closure may be completely removed in one piece by actuation of said actuatable element in either circumferential direction, an anchoring disc underlying the annular portion, a ridge ring connected to the anchoring disc by a series of circumferentially spaced fracturable bridges and an overcap connected to the bridge ring which may be actuated to fracture the bridge ring and expose a stopper in the discharge opening in a container on which the closure is applied

3. A closure device for use with a container, comprising a cap with a pull-tab and scoring to remove said cap, said scoring including stepped scoring on both sides of said pull-tab and a frangible interruption proximate a radial edge of said cap, an anchoring disk located below said cap and having a fracturable bridge means and a removable overcap with an annular portion having a lower terminal edge cooperating with said bridge means whereby removable of said overcap fractures said bridge means and exposes said cap.

4. The closure as claimed in claim 3 wherein said disk and said cap are aluminum and said overcap is plastic.

5. The closure as claimed in claim 3 wherein said interruptions are located proximate to the top radial edge of said cap.

6. The closure as claimed in claim 3 wherein said stepped scoring comprises a first score line extending from said tab to said top edge and a second score line spaced circumferentially from said first score line and extending axially down from said edge.

7. A closure as claimed in claim 3 wherein said stepped scoring decreases the width of the portion of said cap between said scoring below said top radial edge.

8. The closure as claimed in claim 3 wherein said cap further includes radially extending scoring at least at one location remote from said stepped scoring functioning as a hinge during complete removal of the cap from the container.

9. The closure as claimed in claim 3 wherein said cap is made of aluminum and said closure further includes an elastomeric stopper.

* * * * *